US008241015B2

(12) United States Patent
Lillie et al.

(10) Patent No.: US 8,241,015 B2
(45) Date of Patent: Aug. 14, 2012

(54) LINEAR COMPRESSOR

(75) Inventors: Dietmar Erich Bernhard Lillie, Joinville Sc (BR); Egidio Berwanger, Joinville Sc (BR); Raul Bosco, Jr., Joinville Sc (BR); Emerson Moreira, Joinville-SC (BR); Davi Luis Goergen, Joinville-SC (BR); Fabricio Caldeira Possamai, Joinville-Sc (BR)

(73) Assignee: Whirlpool S.A., São Paulo -Sp (BR)

( * ) Notice: Subject to any disclaimer, the term of this patent is extended or adjusted under 35 U.S.C. 154(b) by 888 days.

(21) Appl. No.: 12/297,274

(22) PCT Filed: Apr. 17, 2007

(86) PCT No.: PCT/BR2007/000098

§ 371 (c)(1),
(2), (4) Date: Oct. 15, 2008

(87) PCT Pub. No.: WO2007/118295

PCT Pub. Date: Oct. 25, 2007

(65) Prior Publication Data

US 2009/0280015 A1 Nov. 12, 2009

(30) Foreign Application Priority Data

Apr. 18, 2006 (BR) ..... 0601645

(51) Int. Cl.
*F04B 17/04* (2006.01)

(52) U.S. Cl. ..... 417/416; 417/363; 417/375; 417/410.1; 417/415; 417/417; 417/419

(58) Field of Classification Search ..... 417/416, 417/417, 363, 375, 410.1, 415, 419
See application file for complete search history.

(56) References Cited

U.S. PATENT DOCUMENTS

| | | | | |
|---|---|---|---|---|
| 5,645,407 | A * | 7/1997 | Kralick et al. | 417/383 |
| 5,993,178 | A * | 11/1999 | Park et al. | 417/545 |
| 6,250,895 | B1 * | 6/2001 | Kawahara et al. | 417/363 |
| 6,273,688 | B1 * | 8/2001 | Kawahara et al. | 417/417 |
| 6,398,523 | B1 * | 6/2002 | Hur et al. | 417/417 |
| 6,413,057 | B1 * | 7/2002 | Hong et al. | 417/416 |
| 6,540,490 | B1 * | 4/2003 | Lilie | 417/416 |
| 6,742,998 | B2 * | 6/2004 | Kawahara et al. | 417/416 |

(Continued)

FOREIGN PATENT DOCUMENTS

GB 1222425 2/1971

(Continued)

*Primary Examiner* — Peter MacChiarolo
*Assistant Examiner* — Thomas A Hollweg
(74) *Attorney, Agent, or Firm* — Gifford, Krass, Sprinkle, Anderson & Citkowski, P.C.

(57) ABSTRACT

The invention refers to a linear compressor, comprising: a shell (20); a cylinder (30) affixed to the shell (20) and defining a compression chamber (C); a piston (40) to be displaced in reciprocating movement in the interior of the compression chamber (C) during the operation of the compressor; a linear electric motor (50) mounted to the shell (20); and an actuating means (60) operatively coupling the piston (40) to the linear electric motor (50), in order to make the latter displace the piston (40) in a reciprocating movement in the interior of the compression chamber (C), the actuating means (60) being coupled to the piston (40) by an elastic means (70), so that the actuating means (60) and the piston (40) be displaced in phase opposition during the operation of the compressor.

23 Claims, 10 Drawing Sheets

U.S. PATENT DOCUMENTS

| | | | | |
|---|---|---|---|---|
| 6,860,725 | B2 * | 3/2005 | Park et al. | 417/312 |
| 6,881,042 | B2 * | 4/2005 | Heo et al. | 417/417 |
| 6,884,044 | B2 | 4/2005 | Lilie et al. | |
| 2003/0017064 | A1 * | 1/2003 | Kawahara et al. | 417/417 |
| 2005/0008512 | A1 * | 1/2005 | McGill et al. | 417/416 |
| 2005/0260086 | A1 | 11/2005 | Park | |
| 2008/0240940 | A1 * | 10/2008 | Boyd et al. | 417/307 |
| 2008/0240950 | A1 * | 10/2008 | McGill et al. | 417/437 |

FOREIGN PATENT DOCUMENTS

| | | |
|---|---|---|
| WO | WO-0206698 | 1/2002 |

* cited by examiner

LINEAR COMPRESSOR

CROSS-REFERENCE OF RELATED APPLICATIONS

This application is a US National Phase Application under 35 U.S.C. §371 of International Patent Application No. PCT/BR2007/000098 filed Apr. 17, 2007, which claims priority to and the benefit of, Brazilian Patent Application No. PI0601645-6, filed Apr. 18, 2006, each of which are hereby incorporated by reference in their entirety.

FIELD OF THE INVENTION

The present invention refers to a construction for a linear compressor and, more particularly, to a mounting arrangement for a linear compressor of the type generally used in small refrigeration systems, which allows for the distribution of the forces transmitted from the compressor components to the shell, to which the compressor is mounted. The present compressor can be constructed to be used not only in the refrigeration systems of refrigeration appliances in general, but also for refrigerating the components of compact electronic appliances, or other applications that require the compressor unit to be miniaturized.

PRIOR ART

Linear compressors are known to be applied in refrigeration systems, and their construction has been object of researches generally aiming to improve the efficiency thereof. The linear compressor is basically a high vibration machine which comprises a piston that is axially displaced in the interior of a compression chamber, in order to compress a determined mass of refrigerant gas of the refrigeration system during a refrigeration cycle of this system.

In a linear compressor of a known type and such as that illustrated in FIG. 1, the compression of the gas results from the axial displacement of a piston 1 in the interior of a compression chamber C generally defined within a cylinder 2 having an end opposed to the one in which the piston 1 is mounted and lodged and against which is seated a valve plate 3 which carries a suction valve 3*a* and a discharge valve 3*b*. The cylinder 1 also carries a head 4 mounted on the valve plate 3 and generally sandwiching the latter against the adjacent end of the cylinder 2.

The suction valve 3*a* and the discharge valve 3*b* regulate the inlet and outlet of the gas compressed in the compression chamber C. All of these elements are provided in the interior of a generally hermetic shell 5 presenting a typically cylindrical shape.

In the known prior art constructions, the piston 1 is driven by a linear electric motor, formed by an actuating means 6 presenting a ring-shaped base portion which is affixed to the piston 1, and a load portion which supports a toroidal-shaped magnetic member 7 typically formed by a plurality of permanent magnets, which are carried by the actuating means 6. The linear electric motor further includes a stator 8 generally affixed to the shell 5 of the compressor through appropriate suspension elements 9. In this construction, the piston 1, the actuating means 6 and the magnet member 7, which define a resonant or movable compressor assembly that moves in relation to the cylinder 2, are operatively mounted to a cylinder block 2*a*, in which is defined the cylinder 2 through an elastic means 10 generally in the form of a helical or flat spring. The cylinder 2, the cylinder block 2*a* and the elements affixed to it, such as the head 4, are stationary. These elements will be hereafter referred to as reference assembly or stationary assembly.

In this prior art construction, the elements of the reference assembly of the compressor carry the elements of the resonant assembly, the reference assembly being mounted to the shell 5 through the suspension elements 9. As illustrated in FIG. 1 of the enclosed drawings, in this prior art construction, the resonant and reference assemblies of the compressor are mounted to the bottom wall of the shell 5 by one or a plurality of elastic suspension elements 9 of the helical spring type. The function of the suspension elements 9 is to minimize the transmission of vibration from the piston to the shell 5. During the compressor operation, the elements of the resonant assembly are displaced by the linear electric motor in relation to the elements of the reference assembly. The displacement of the reference assembly supported by the suspension elements 9 transmits a force to the shell 5 of the compressor when the resonant assembly is reciprocated, making the shell 5 vibrate. This vibration is undesirable for this type of compressor, especially when used in residential refrigeration systems. Hence, it is desirable to provide a mounting arrangement for such type of linear compressor, which can reduce the amount of vibration and which is simple and inexpensive in construction and assembly.

In order to obtain acceptable levels of vibration, it is necessary to have a vibration control means. In general, there are three known prior art methods for controlling the vibration of the resonant assembly in the interior of the shell 5.

A first method uses a spring which reacts against the force of the suspension elements of the compressor on the shell (U.S. Pat. No. 6,884,044).

A second method uses low rigidity of the suspension elements of the compressor to minimize the forces transmitted to the shell or to the structure where said compressor is mounted.

A third known method utilizes a dynamic neutralizer which, through a resonant system, creates a counter vibration, in order to reduce the vibration effects of the resonant assembly.

However, in these prior art solutions, the whole mass of the resonant assembly is displaced as a single body in one and in an opposite direction during the reciprocating displacement of the piston. Although the known vibration control methods allow an acceptable level of vibration in such compressors to be obtained, said acceptable level is mostly dictated by the available space within the dimensional limitations for the provision of the different vibration control means in the compressor project.

Considering the dimensional limitations of these compressors, the known solutions, in which the elements of the resonant assembly are defined as a single body, do not allow the vibration control means to be dimensioned to practically annul the vibrations transmitted to the compressor shell. Thus, it is highly desirable to reduce even more the vibration levels produced in a compressor of the type considered herein, without negatively affecting the overall dimension of the compressor.

As a consequence of the need for maintaining the vibration control means in the prior art solutions, these known linear compressors require larger shell dimensions for mounting said vibration control means, which leads to the necessity of a larger physical space to install the compressor and to a heavier compressor.

These drawbacks related to the increase of dimensions and weight of the compressor become even more critical in case said compressors are applied in refrigeration systems of electronic equipment, or in applications which demand miniaturizing the compressor unit, in which the dimensions and weight have to be mandatorily reduced. Thus, it is advantageous to provide a constructive solution which permits miniaturizing and, preferably, suppressing said vibration control means and the suspension elements to reduce dimensions of a linear compressor.

Besides the dimensional problems cited above, the known compressor constructions, which include one of the known vibration control means, present problems related to the required flexible connections, since in these constructions the compressor moves in relation to the surrounding shell. During shipping of the compressor, due to the relative movement between the reference assembly and the shell, a collision may occur between the shell and the elements suspended therein by the flexible connections, requiring solutions for providing a stronger product, increasing the manufacturing and shipping costs.

SUMMARY OF THE INVENTION

As a function of the drawbacks commented above and other disadvantages of the known constructive solutions, it is one of the objects of the invention to provide a linear compressor comprising a reference assembly and a resonant assembly, which are lodged in the interior of a shell, and presenting a mounting arrangement of the elements of the resonant assembly which allows to practically annul the levels of the vibrations transmitted from the reference and resonant assemblies to the compressor shell.

A further object of the present invention is to provide a compressor, as cited above and which does not require the provision of vibration control means and suspension elements for defining flexible connections between the shell and the reference assembly.

Another object of the present invention is to provide a linear compressor, as cited above and whose construction permits a substantial reduction of the dimensions of the compressor shell and also of the overall weight of the latter.

Still another object of the present invention is to provide a compressor, as cited above and which does not present problems such as the possibility of occurring collision between the components of the reference assembly and the compressor shell.

The present invention refers to a linear compressor of the type which comprises: a shell; a cylinder affixed to the shell and defining a compression chamber; a piston that reciprocates in the interior of the compression chamber during the operation of the compressor; a linear electric motor mounted to the shell; an actuating means operatively coupling the piston to the linear electric motor, in order to make the latter displace the piston in a reciprocating movement in the interior of the compression chamber.

According to the invention, the actuating means is coupled to the piston by an elastic means, so that the actuating means and the piston are displaced in phase opposition during the compressor operation.

According to a particular aspect of the present invention, the elastic means, coupling the actuating means to the piston, presents an axis that is coaxial to the displacement axis of the piston and is dimensioned as a function of the masses of the piston and the actuating means and of the displacement amplitudes that are predetermined for the actuating means and for the piston, said amplitudes being related to a plane transversal to the axis of the elastic means, defined at a predetermined distance in relation to a reference point contained in one of the parts of the cylinder and the shell, said amplitudes being calculated to provide a determined power for the linear electric motor and a determined gas pumping efficiency for the piston.

In another aspect of the present invention, the compressor of the present invention also includes, in a particular construction, a positioning element coupling the region of the elastic means situated on said transversal plane, or one of the parts defined by the piston or by the actuating means to one of the parts defined by the cylinder and by the shell, so as to force the maintenance of the condition of phase opposition displacements between the piston and the actuating means and of their displacement amplitudes.

A further aspect of the present invention is to provide a linear compressor, as defined above and in which the shell comprises an elongated tubular body internally defining a hermetic chamber between the linear electric motor and the cylinder, said hermetic chamber being open to a first end of the compression chamber and lodging the actuating means and the elastic means; said compressor further comprising: a valve plate seated and affixed against a second end of the compression chamber, in order to close it; an end cover externally seated and retained against the valve plate, said end cover and said valve plate internally providing selective fluid communications between the compression chamber and the suction and discharge lines, respectively, of a refrigeration circuit to which the compressor is coupled.

BRIEF DESCRIPTION OF THE DRAWINGS

The invention will be described below, with reference to the enclosed drawings, given by way of example of possible embodiments of the present invention and in which.

DESCRIPTION OF THE ILLUSTRATED EMBODIMENTS

Figure 3:
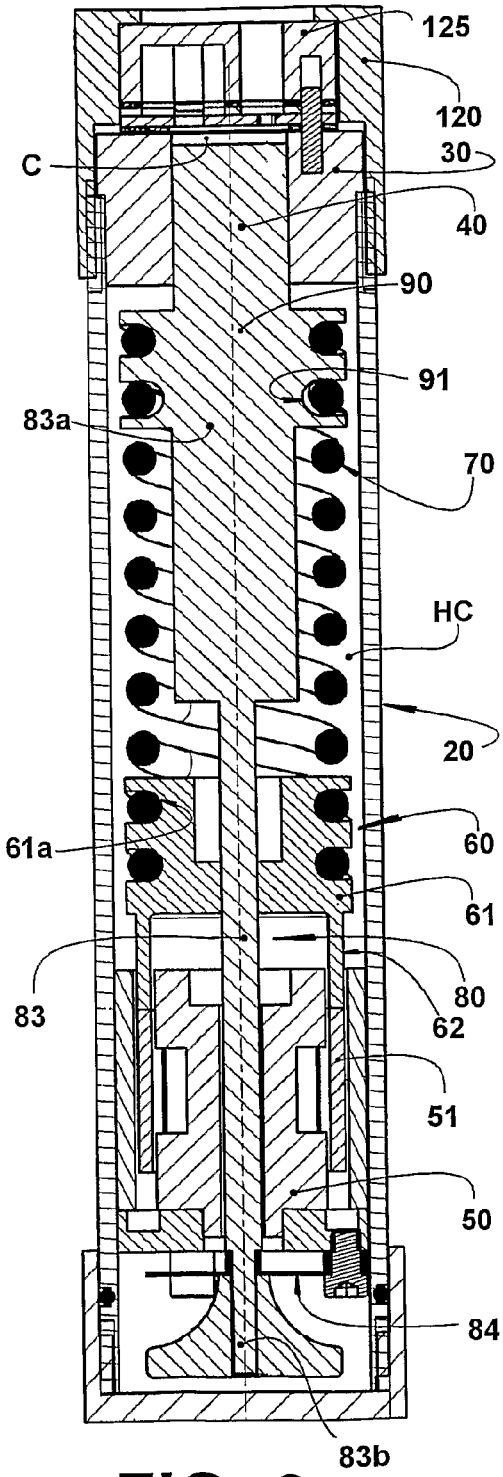
FIG. 3 represents, in a simplified and rather schematic way, a longitudinal sectional view of a compressor construction according to the present invention and in which, besides the elastic means, an elastic positioning means is provided between the piston and the shell.

The present invention comprises a compressor for refrigeration systems, for example, as set forth in FIG. 3, a compact compressor of the type to be particularly, but not exclusively, utilized to refrigerate electronic systems, said compressor generically comprising a shell 20; a cylinder 30 affixed to the shell 20 and defining a compression chamber C; a piston 40 reciprocating in the interior of the compression chamber C during the operation of the compressor; a linear electric motor 50 mounted to the shell 20; an actuating means 60 operatively coupling the piston 40 to the linear electric motor 50, so as to make the latter displace the piston 40 in a reciprocating movement inside the compression chamber C.

In the solution of the present invention, the actuating means 60 is coupled to the piston 40 by an elastic means 70 designed so that the actuating means 60 and the piston 40 are displaced in phase opposition during the operation of the compressor, as exposed ahead.

In the prior art constructions, in which the piston 1 is maintained rigidly affixed to the actuating means 6, the operation of the linear electric motor drives the actuating means 6 in order to displace it in a reciprocating movement, which is instantaneously and directly transmitted to the piston 1, which begins to reciprocate jointly with the actuating means 6, in a movement having the same displacement direction and amplitude as the latter. This joint movement gives rise to vibrations in the compressor, requiring the use of vibration compensating mechanisms, such as for example, a suspension spring, as discussed hereinbefore.

With the solution of the present invention, the piston 40 is no more directly and rigidly affixed to the actuating means 60, resulting in a reciprocating displacement that ceases to correspond to the reciprocating displacement of the actuating means 60. In the solution of the present invention, the reciprocating movement of the piston 40 is operatively associated with that movement determined for the actuating means 60 by the linear electric motor 50, allowing said piston 40 to present a displacement which is offset or in phase opposition, i.e., in a direction opposed to that of the actuating means 60 and said displacement may also present an amplitude different from that of the reciprocating displacement of the actuating means 60. This freedom of movement between the piston 40 and the actuating means 60 allows the relative reciprocating displacements to be previously defined to annul the vibrations caused by each said reciprocating displacement. The displacement amplitudes of the piston will be smaller than those associated with the actuating means 60, as a function of the different masses of the two parts associated with the elastic means 70.

The elastic means 70, which operatively couples the piston 40 to the actuating means 60 of the present invention, is defined not only to guarantee the physical coupling between the parts of piston 40 and actuating means 60, but also to determine the transfer of movement from the linear electric motor 50 to the piston 40, in a determined amplitude, frequency and phase relation with the movement of the actuating means 60. In the illustrated constructions, the elastic means 70 presents an axis coaxial to the displacement axis of the piston 40.

According to one aspect of the present invention, the elastic means 70 is dimensioned as a function of the masses of the piston 40 and the actuating means 60, and of displacement amplitudes that are desired and predetermined for said parts of actuating means 60 and piston 40. The displacement amplitudes of the piston 40 and actuating means 60 are defined in relation to a transversal plane P, orthogonal to the axis of the elastic means 70, defined at a predetermined distance in relation to a reference point contained in one of the parts of cylinder 30 and shell 20, said amplitudes being calculated to guarantee a determined power for the linear electric motor 50 and a determined gas pumping efficiency for the piston 40.

The elastic means 70 coupled to the parts of piston 40 and actuating means 60 maintains stationary its region disposed on said transversal plane P, defining a point zero of the amplitude of the compressor operation, in which the vibration caused by the movement of each of the parts of piston 40 and actuating means 60 presents a null resultant, independent of the difference between the amplitudes being balanced.

The present invention permits to reduce the dimensions of both the piston 40 and the linear electric motor 50, and to consequently reduce the dimensions of the compressor. Since the piston 40 is not directly coupled to the actuating means 60 and the displacement travels of said parts are independent, it is possible to control the operation efficiency of both the piston 40 and the linear electric motor 50.

The increase of the displacement travel of the actuating means 60 in relation to the displacement travel of the known constructions (and in relation to the displacement travel of the piston 40, to which it is no more directly related) allows reducing the dimensions of the linear electric motor 50, without causing loss of power to said linear electric motor 50, further allowing to reduce the dimensions of the compressor. The determination of the travel amplitudes of both the piston 40 and the actuating means 60 is made by determining the masses and the spring constant of the elastic means 70.

In the compressor constructions in which the travel of the piston 40 is not modified, the displacement amplitude of the actuating means 60 is defined so that to be greater than the displacement amplitude of the piston 40, allowing the desired power to be obtained with an electric motor of reduced dimensions, for example, of smaller diameter, but without the necessary increase of the travel of the actuating means 60 provoking alteration in the travel of the piston 40 and, consequently, in the pumping capacity thereof.

Balancing the vibrations caused by the operation of both the piston 40 and the actuating means 60 also allows reducing the dimensions and the shape of the compressor shell 20, as described ahead.

Figure 1:
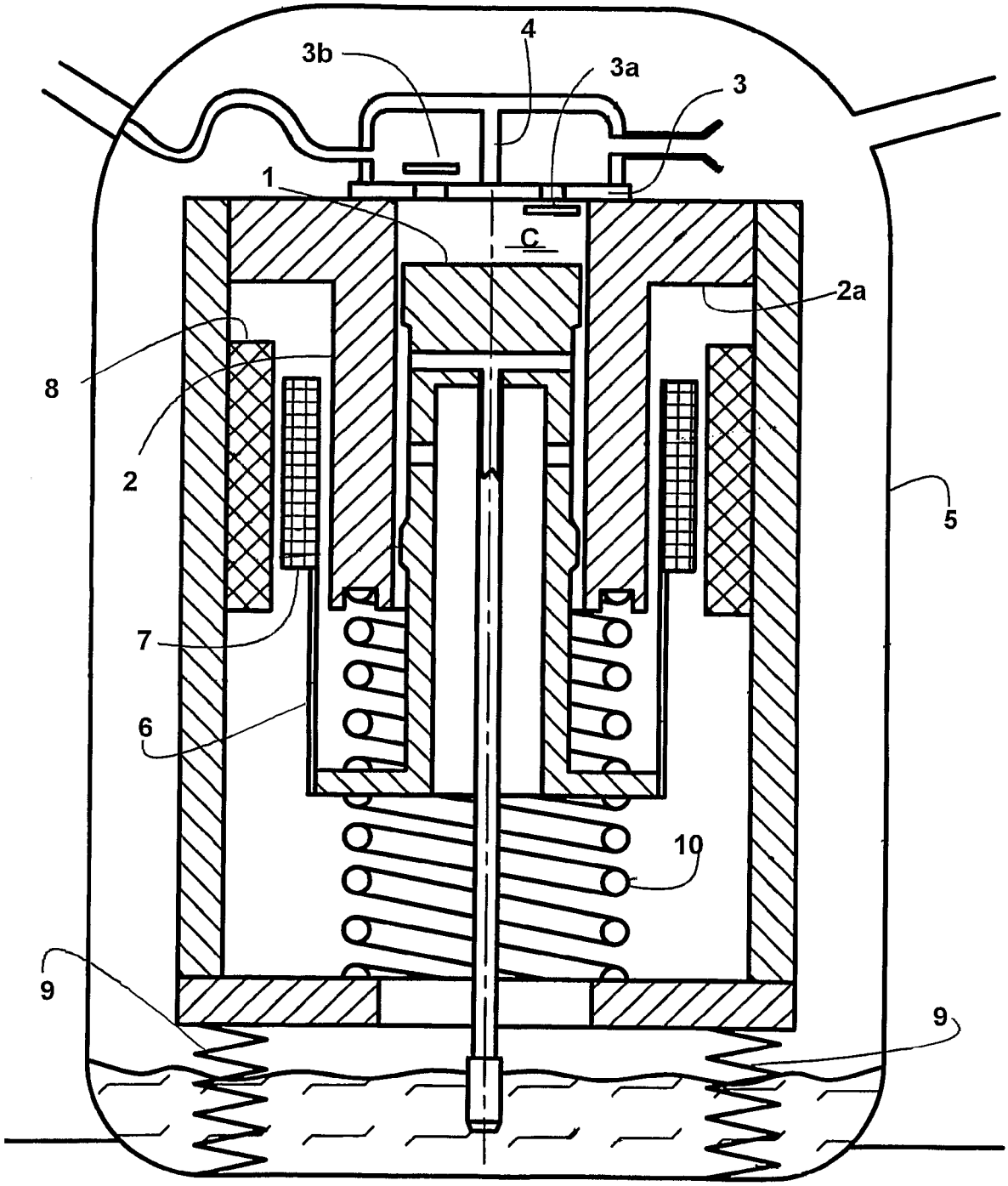
FIG. 1 PRIOR ART
FIG. 1 schematically represents a longitudinal sectional view of a construction of a prior art linear compressor.
Figure 2:
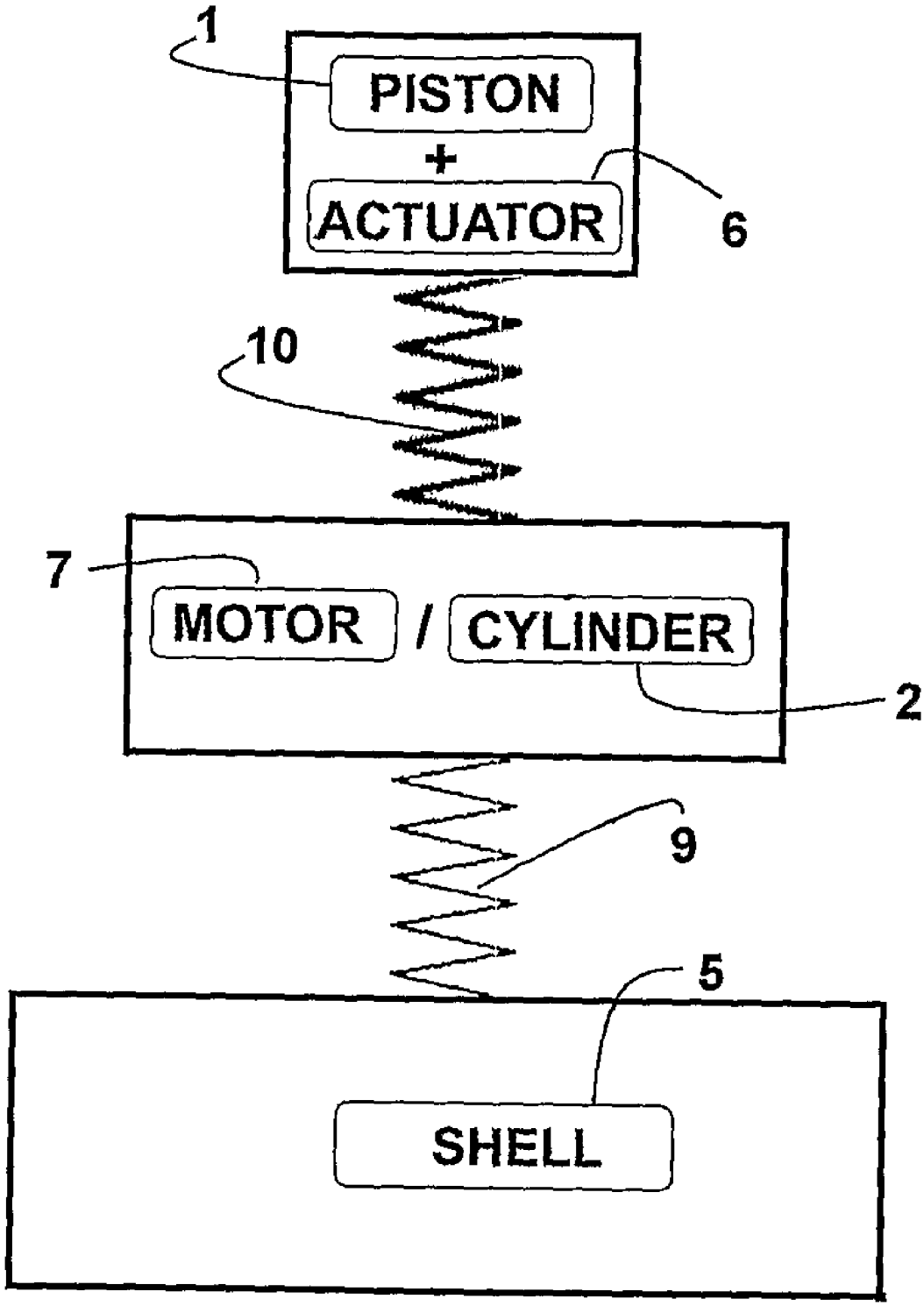
FIG. 2 PRIOR ART
FIG. 2 represents a schematic diagram of the compressor of FIG. 1, illustrating the operational relationship of a resonant spring with the resonant assembly (piston/actuating means) and with the reference assembly (shell) and also of a suspension spring with the reference assembly (shell)

Although the compressor being described can be mounted in the interior of a conventional shell, such as that illustrated in FIG. 1, the present invention is herein described in relation to a construction of a shell 20 of the type used in compact linear compressors, as illustrated in FIGS. 3, 4, 9, 11, 13 and 15 of the enclosed drawings.

According to the present invention, the actuating means 60 generally comprises a base portion 61, which secures the elastic means 70, and a load portion 62 electromagnetically associated with the linear electric motor 50, said base portion 61 and load portion 62 being preferably coaxial to one another and to the axis of the piston 40, and the base portion 61 carries the load portion 62. In a way of carrying out the present invention, the base portion 61 secures the load portion 62 by a known conventional way, such as adhesive, threads, interference, etc, or incorporates said load portion 62 in a single piece. The load portion 62 carries magnets 51 of the linear electric motor 50.

In a way of carrying out of the present invention, the load portion 62 is defined by a tubular skirt projecting from the base portion 61, from a face thereof opposite to that one turned to the piston 40.

According to the illustrated constructions, the load portion 62 has the shape of a segmented tubular skirt, defining arched skirt portions, with at least part of said portions carrying, from a free end opposite to the base portion 61, or in a respective inner face of the arched skirt, a magnet 51. In another constructive option, at least part of the arched skirt portions is constructed in a magnetic material and defines the magnet of the linear electric motor 50.

In accordance with this constructive form of the present invention, the elastic means 70 has an end affixed to the piston 40 and an opposite end affixed to the base portion 61 of the actuating means 60. In a variant of this construction, exemplarily illustrated in FIGS. 3, 4, 7, 9, 11 and 13, the fixation of the elastic means 70 to the piston 40 achieved by fastening an end of the elastic means 70 to a drive rod portion 90, external to the cylinder 30 and coaxial to the piston 40, which drive rod portion 90 may be provided with receiving and retaining means of said adjacent end of the elastic means 70, or incorporating these in a single piece. The drive rod portion 90 can be also defined in a single piece with the piston 40 or coupled to it, the elastic means 70 being preferably defined by one or two resonant helical springs with the same helical development direction and having their adjacent ends angularly spaced from each other.

According to one embodiment of the present invention, the compressor further comprises a positioning element 80 coupling the region of the elastic means 70, situated on said transversal plane P orthogonal to the axis of the elastic means 70, to one of the parts of cylinder 30 and shell 20, as illustrated in FIGS. 9-12.

Figure 13:
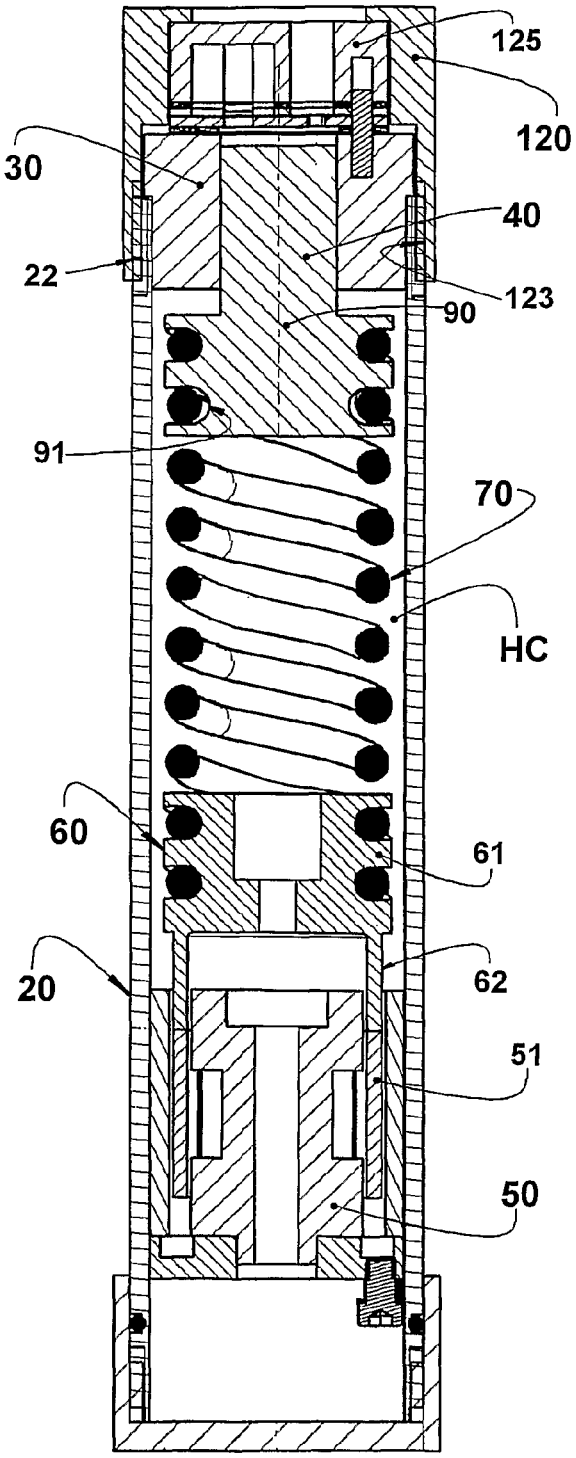
FIG. 13 represents, in a simplified and rather schematic way, a longitudinal sectional view of another compressor construction according to the present invention, without the positioning means.
Figure 14:
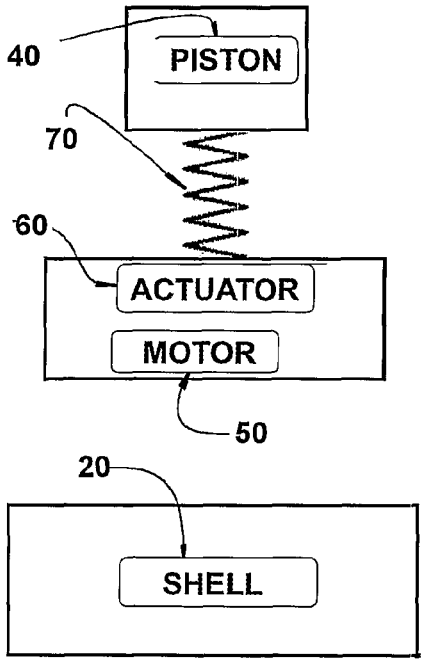
FIG. 14 represents a schematic diagram of the compressor of FIG. 13, illustrating the operational relationship of the elastic means with the piston and with the actuating means.
Figure 15:
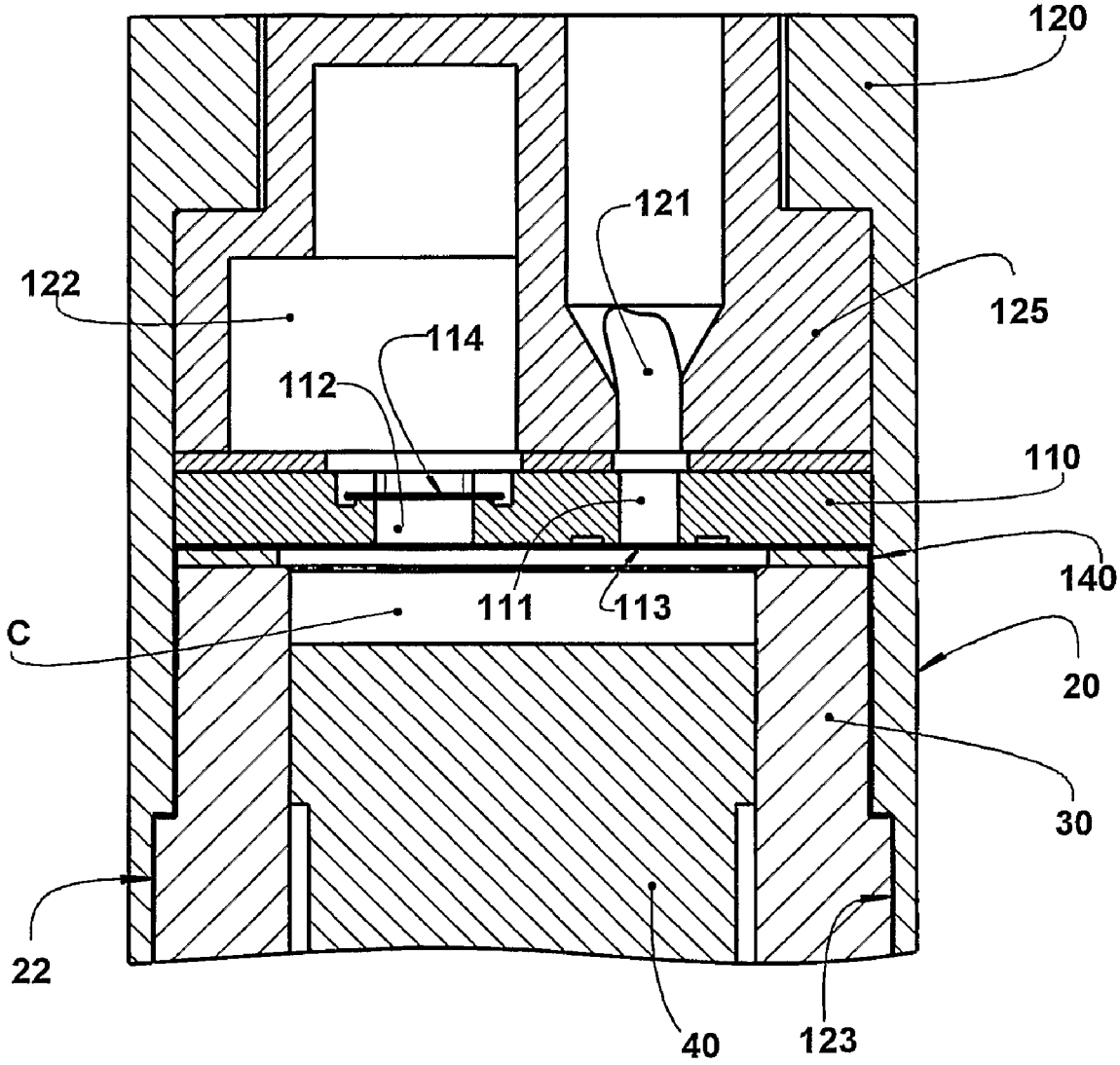
FIG. 15 represents, in a simplified and rather schematic way, an enlarged longitudinal sectional view of the top region of the cylinder, the piston being in an intermediary position of its compression cycle.

In the construction illustrated in FIGS. 13 and 14, the assembly formed by the piston 40, actuating means 60 and elastic means 70 does not present a positioning element to connect it to a part of the reference assembly of the compressor, such as the shell or the cylinder. In this construction, the oscillation amplitudes of the piston 40 and of the actuating means 60 are maintained without substantial alteration during the compressor operation, and the elastic means 70 is designed so that, even in conditions in which eventually one or both of the cited displacement amplitudes surpass the nominal value previously determined in project, said nominal value of displacement amplitude is re-established.

According to the present invention, the positioning element 80 presents two possible constructions: a rigid construction and an elastic construction, as described ahead.

Figure 11:
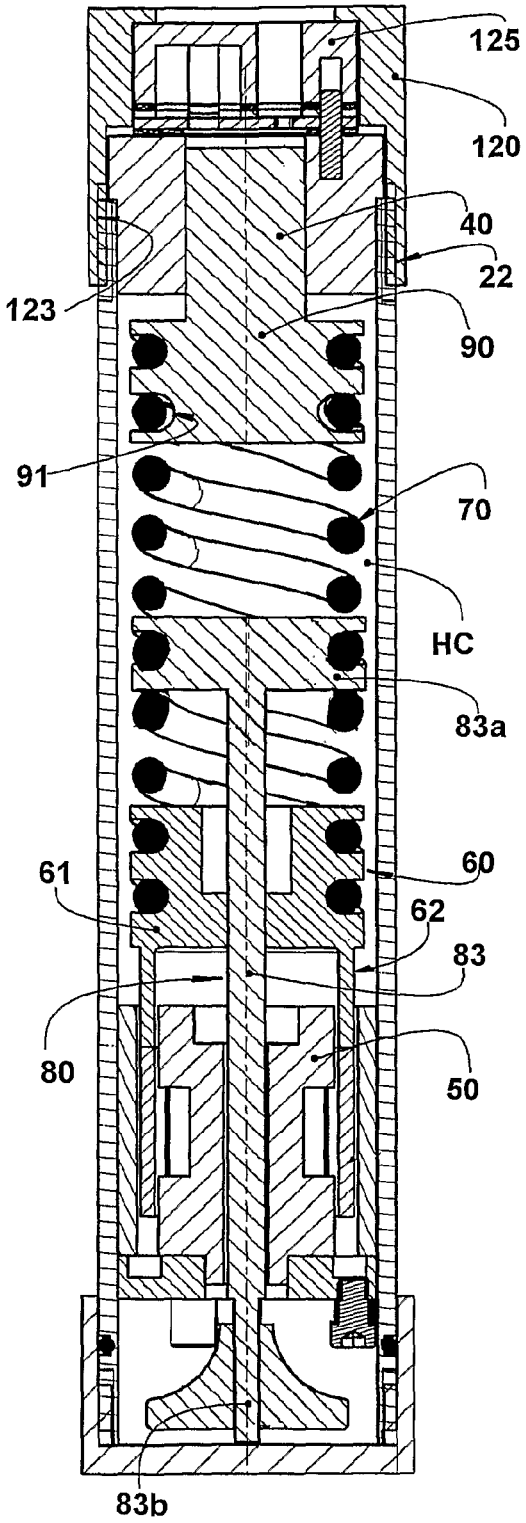
FIG. 11 represents, in a simplified and rather schematic way, a longitudinal sectional view of another compressor construction according to the present invention and in which is provided a rigid positioning means, coupling the shell to the elastic means region situated on the transversal plane.
Figure 12:
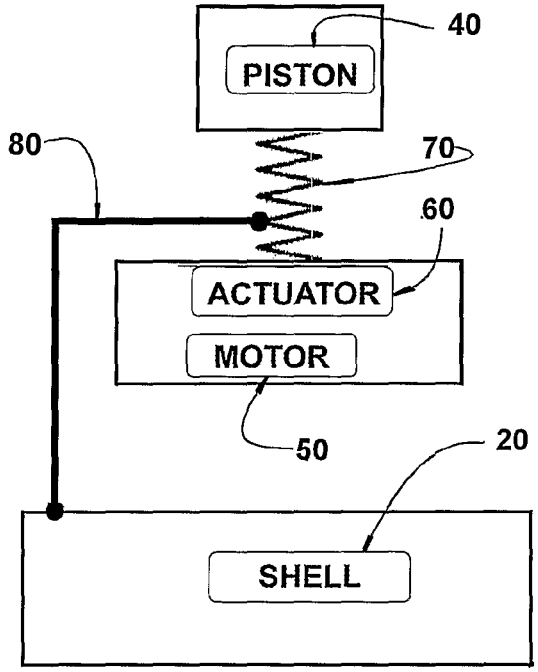
FIG. 12 represents a schematic diagram of the compressor of FIG. 11, illustrating the operational relationship of the elastic means with the piston and with the actuating means and the operational relationship of said elastic means with the shell, through the positioning means.

In a constructive form of the present invention, the positioning element 80 rigidly couples the region of the elastic means 70, situated on said transversal plane P, to one of the parts of cylinder 30 and shell 20, maintaining said positioning element 80 affixed in relation to the respective part. FIGS. 11 and 12 exemplify a possible construction of a rigid positioning element 80 comprising a positioning rod 83 having an end 83*a* coupled to the elastic means 70 in the region of the transversal plane P and an opposite end 83*b* affixed to the shell 20, although said second end 83*b* may be also affixed to the cylinder 30. In the illustrated construction, the positioning rod 83 is coaxial to the axis of the piston 40 and disposed through the base portion 61 of the actuating means 60.

In another constructive form of the present invention, not illustrated, the positioning element 80, presenting a rigid construction, can be defined by an annular cradle securing the region of the transversal plane P of the elastic means 70 against the adjacent inner surface of the shell 20. However, it should be understood that the positioning element 80 may present different constructions.

According to the present invention, the elastic means 70 comprises at least one resonant helical spring with an end coupled to the piston 40 and an opposite end coupled to the actuating means 60. In the illustrated construction, the elastic means 70 comprises two resonant helical springs presenting the same helical development and having their adjacent ends offset from each other in about 180°. In the construction in which the elastic means 70 comprises more than two resonant helical springs, these present an angular distribution defining a plane of symmetry (for example, with the same spacing) for the adjacent ends of said resonant helical springs. In the constructions presenting an elastic means 70 in the form of helical springs coaxial to the axis of the piston 40, the positioning rod portion 83 is disposed axially and internally in relation to the resonant helical spring(s) which define(s) the elastic means 70.

Figure 9:
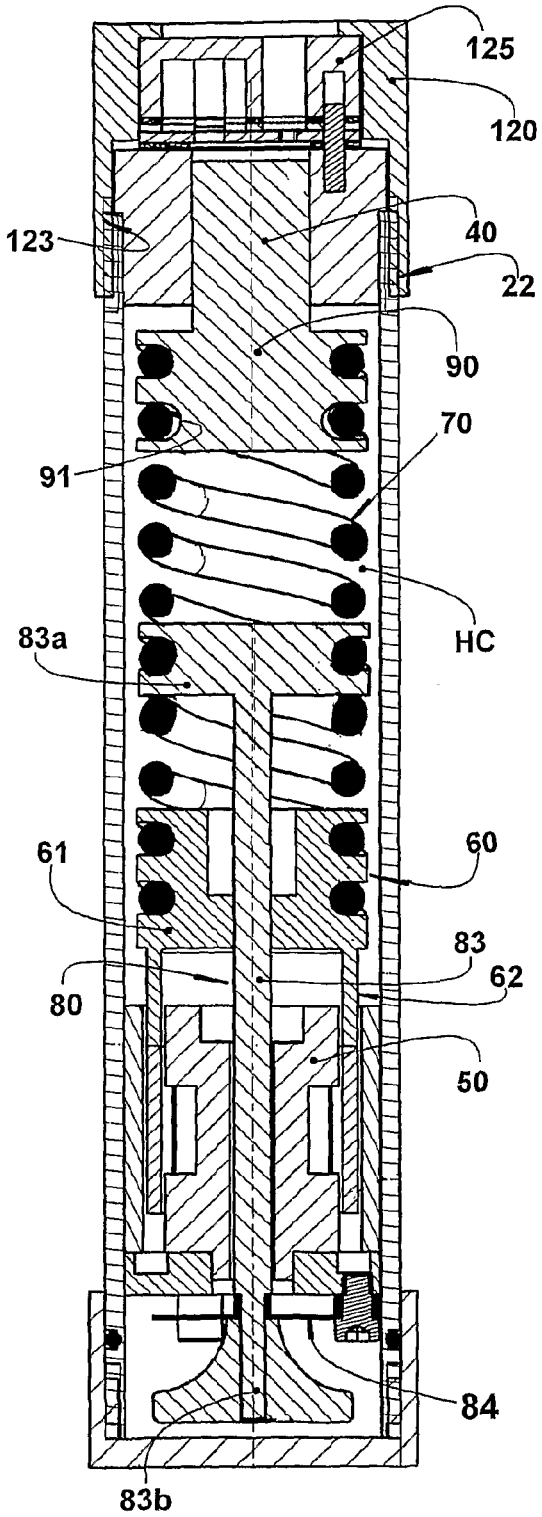
FIG. 9 represents, in a simplified and rather schematic way, a longitudinal sectional view of another compressor construction according to the present invention and in which there is an elastic positioning means, coupling the shell to the elastic means region situated on the transversal plane.
Figure 10:
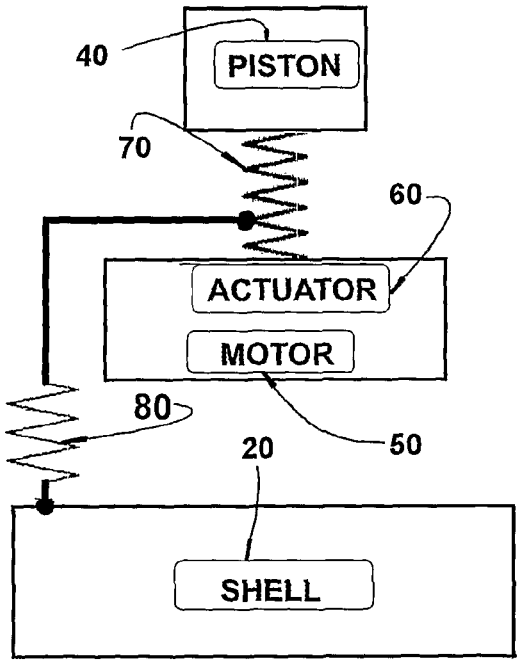
FIG. 10 represents a schematic diagram of the compressor of FIG. 9, illustrating the operational relationship of the elastic means with the piston and with the actuating means and the operational relationship of said elastic means with the shell, through the positioning means.

In another constructive form of the present invention, the positioning element 80 elastically couples the region of the elastic means 70, situated on said transversal plane P, to one of the parts of cylinder 30 and shell 20, said positioning element 80 forcing the maintenance of the distances between the transversal plane P and the reference point contained in one of the parts of shell 20 and cylinder 30. FIGS. 9 and 10 exemplify a possible construction for an elastic positioning element 80 in which said positioning element 80 comprises, besides the positioning rod 83, a spring element 84 of the helical or flat type which, in the illustrated construction, affixes the opposite end 83*b* of the positioning rod 83 to the shell 20.

In the constructions in which the positioning element 80 is elastic and comprises a spring element, this presents a portion coupled to one of the parts of cylinder 30 and shell 20 and an opposite portion affixed to the region of the elastic means 70 situated on said transversal plane P, through the positioning rod 83, disposed axially and internally in relation to a resonant helical spring which defines the elastic means 70 and which presents an end coupled to the piston 40 and an opposite end coupled to the actuating means 60. In this construction, also the positioning rod portion 83 is disposed through a central opening provided in the base portion 61 of the actuating means 60, coaxial to the axis of the piston 40.

In a way of carrying out this constructive option, the positioning element 80 comprises a spring element 84, in the form of a flat spring peripherally affixed to the shell 20 and medianly affixed to the positioning rod 83, such as illustrated in FIG. 9.

Within the concept presented herein regarding the elastic positioning element 80, the present solution provides a construction in which said positioning element 80 is mounted to one of the parts of shell 20 and cylinder 30, being elastically and operatively associated with one of the parts of piston 40 and actuating means 60, in order to force the maintenance of the condition of phase opposition displacements between the piston 40 and the actuating means 60, as well as said displacement amplitudes foreseen for these parts in the compressor project.

In a constructive form of this concept, the positioning element 80 comprises a spring element 84 having a portion coupled to one of the parts of cylinder 30 and shell 20 and an opposite portion affixed to one of the parts of piston 40 and actuating means 60 through the positioning rod 83, as exemplified in FIGS. 3, 4, 5, 7 and 8 of the enclosed drawings.

Figure 4:
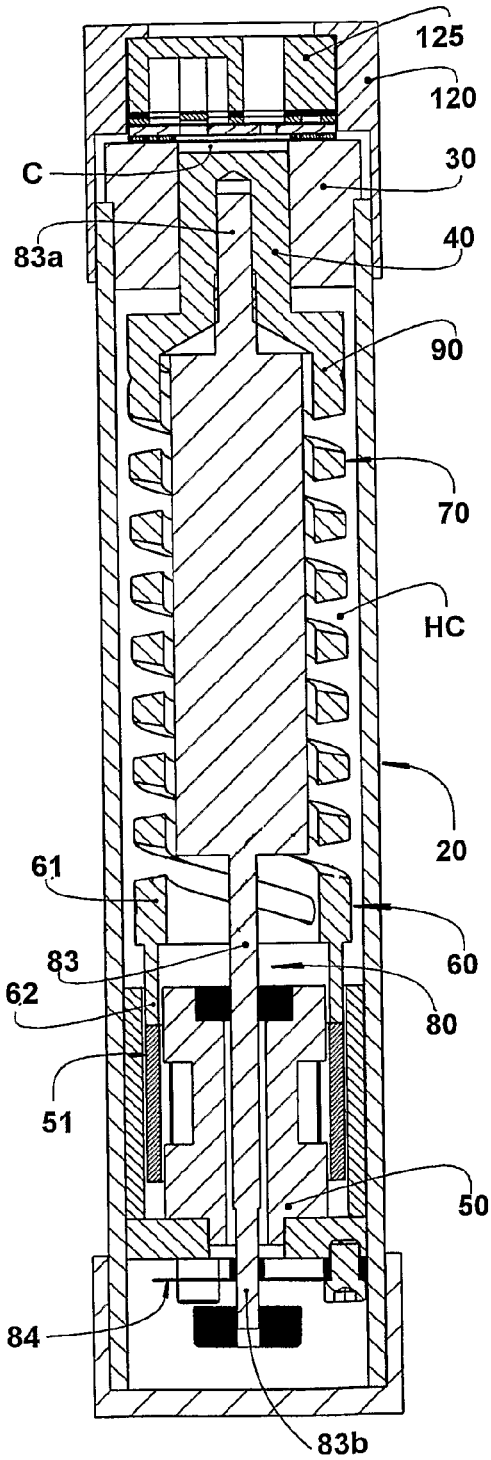
FIG. 4 represents, in a simplified and rather schematic way, a longitudinal sectional view of another compressor construction according to the present invention and in which, besides the elastic means, an elastic positioning means is provided between the piston and the shell.
Figure 5:
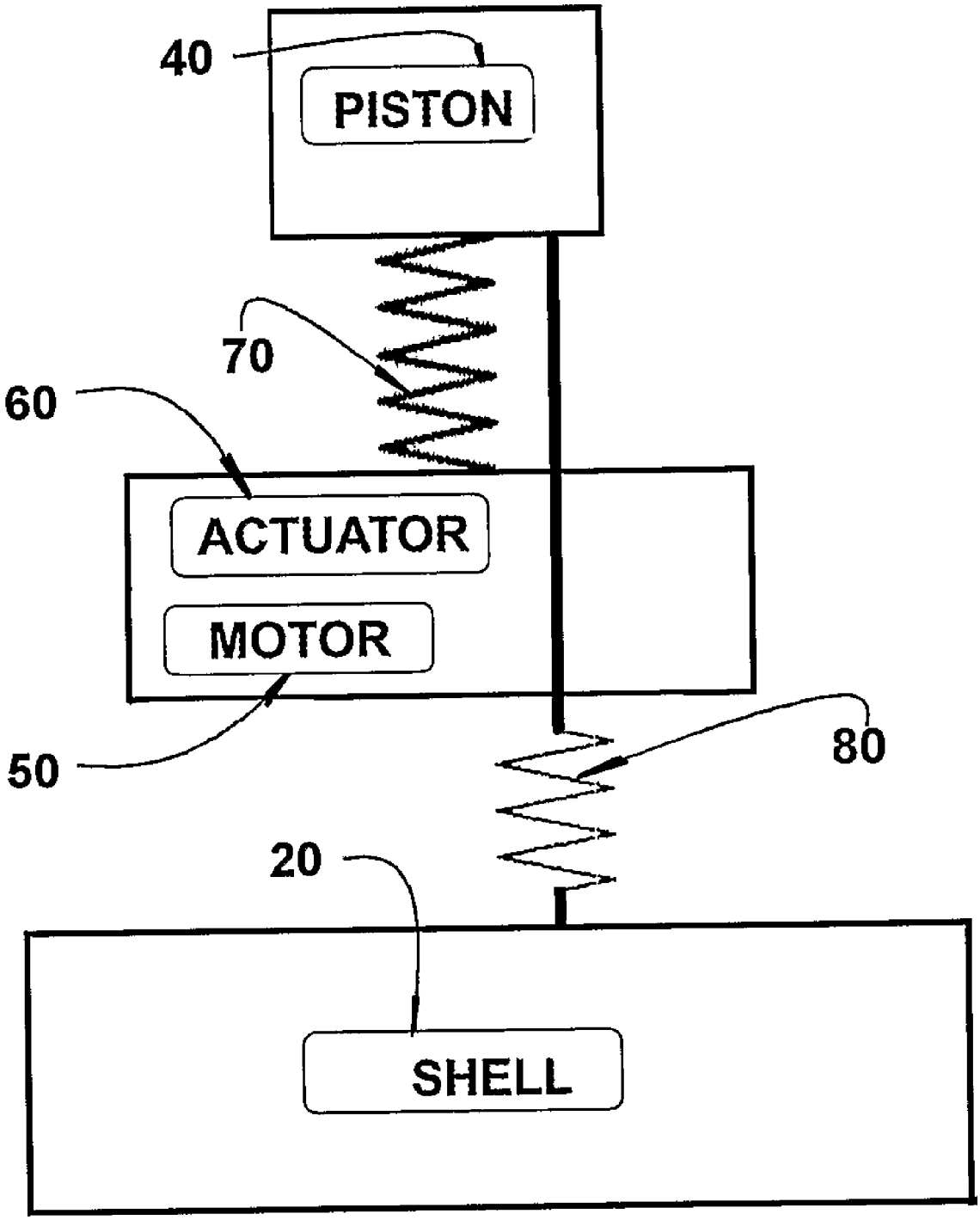
FIG. 5 represents a schematic diagram of the compressor of FIGS. 3 and 4, illustrating the operational relationship of the elastic means with the piston and with the actuating means and also of said piston with the shell, through the positioning means.
Figures 6A, 6B, 6C:
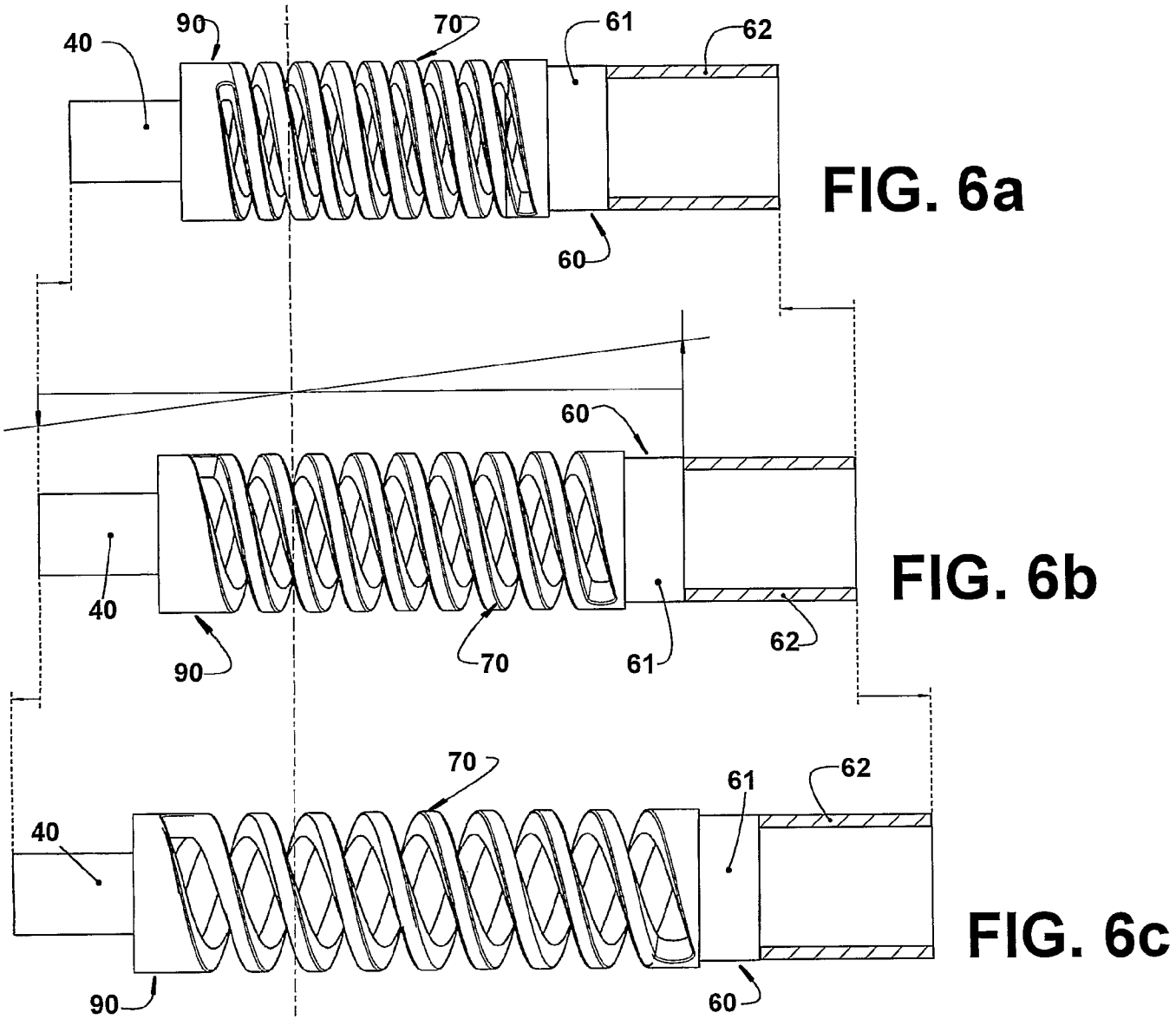
FIGS. 6*a*, 6*b* and 6*c* illustrate the piston, the actuating means and the elastic means in three operational positions of the piston compression cycle, respectively representing a condition of maximum compression of the elastic means, no compression and maximum expansion of the elastic means, the displacement amplitudes of the piston and of the elastic means being graphically and schematically indicated by associating FIG. 6*b* with FIGS. 6*a* and 6*c;*

FIGS. 3-5 present constructions in which the positioning element 80 has the end 83*a* of the positioning rod 83 coupled to the piston 40 and the opposite end 83*b* coupled to the shell 20, through a spring element 84 in the form of a flat spring. In these constructions, the piston 40 is coupled to the elastic means 70 by a drive rod portion 90 external to the cylinder 30 and coaxial to the piston 40 and the positioning rod 83 is defined by an additional extension of the drive rod portion 90.

In both illustrated constructions, the drive rod portion 90 defines a body, which is enlarged in relation to the piston 40 and which can be produced, for example, in a single piece with said piston 40 and with the positioning rod 83. In the construction of FIG. 3, the drive rod portion 90 defines housings 91, which receive and secure an end of the elastic means 70 which, in the illustrated construction, comprises at least one resonant helical spring with an end coupled to the piston 40, through said drive rod portion 90 and an opposite end coupled to the actuating means 60. In this construction, the positioning rod 83 is disposed axially and internally in relation to the resonant helical spring.

In the construction illustrated in FIG. 4, the drive rod portion 90 is affixed to an adjacent end of the elastic means 70 which, in the illustrated construction, also comprises at least one resonant helical spring with an end coupled to the piston 40, through said drive rod portion 90, and an opposite end coupled to the actuating means 60. In this construction, the positioning rod 83 is disposed axially and internally in relation to the resonant helical spring and said positioning rod 83 is affixed to the parts of piston 40 and drive rod portion 90 through a central opening provided in the piston 40 and in the drive rod portion 90, axially to the axis of the piston 40.

In the construction illustrated in FIGS. 3 and 4, the positioning rod 83 has its diameter reduced in the region adjacent to the actuating means 60, so that said positioning rod 83 traverses, coaxially to the axis of the piston 40, a central opening provided in the base portion 61 of the actuating means 60, in order to connect the piston 40 to the spring element 84 of the positioning element 80. In these constructions, the base portion 61 of the actuating means 60 secures another end of the elastic means 70, opposed to the one affixed to the piston 40. As described above, the actuating means 40 further comprises a load portion 62 electromagnetically associated with the linear electric motor 50.

In the construction illustrated in FIG. 3, the base portion 61 of the actuating means 60 presents, along its periphery, housings 61*a* to receive and secure an adjacent end of the elastic means 70, as described in relation to the drive rod portion 90. In the construction of FIG. 4, the base portion 61 of the actuating means 60 incorporates the adjacent end of the elastic means 70, defining, jointly with the piston 40, a single piece.

In the constructions illustrated in FIGS. 3 and 4, the positioning element 80 further comprises a spring element 84 in the form of a flat spring that is peripherally affixed to the shell 20 and medianly affixed to the adjacent opposite end 83*b* of the positioning rod 83.

Figure 7:
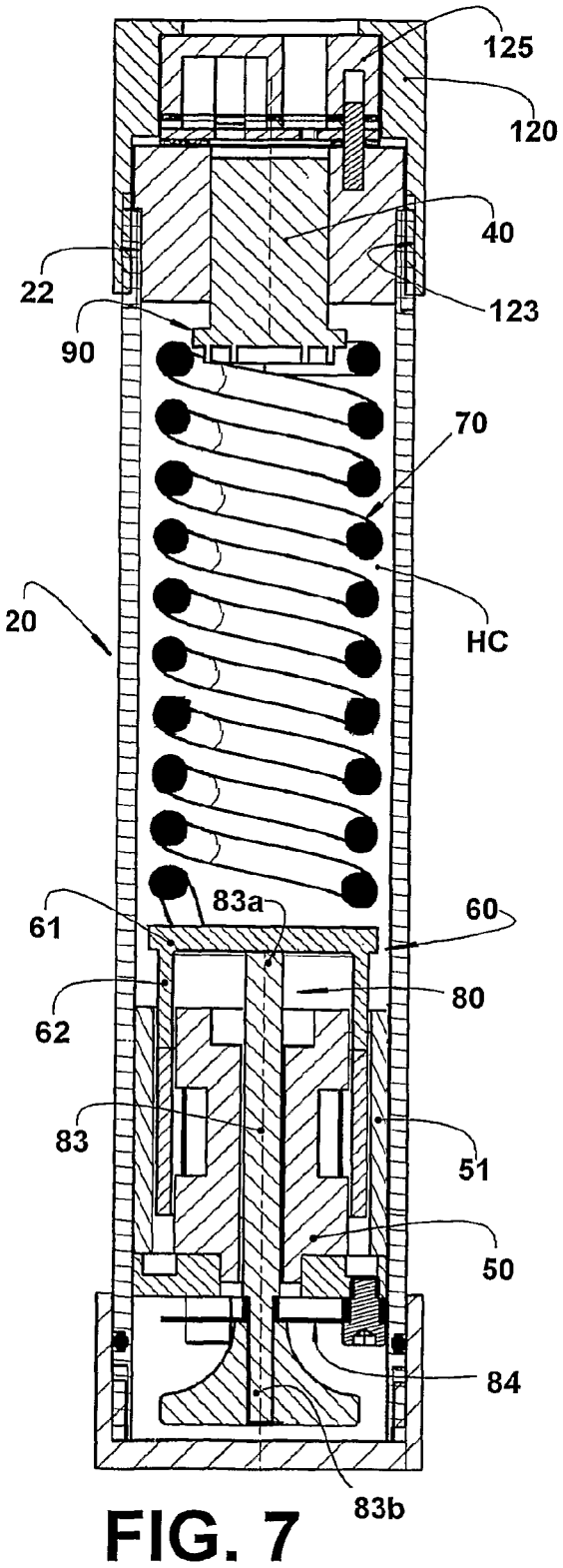
FIG. 7 represents, in a simplified and rather schematic way, a longitudinal sectional view of another compressor construction according to the present invention and in which there is an elastic positioning means coupling the actuating means to the shell.
Figure 8:
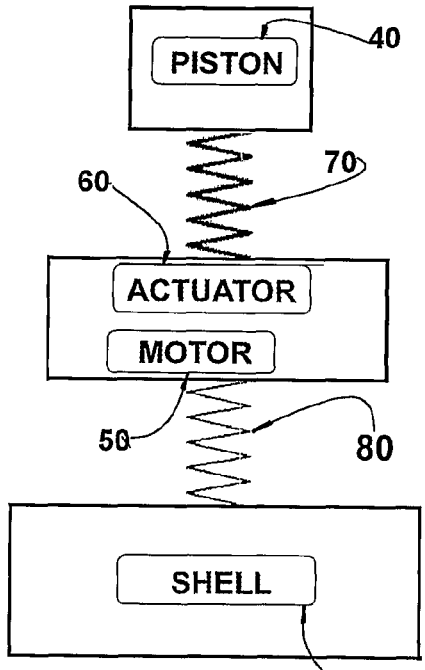
FIG. 8 represents a schematic diagram of the compressor of FIG. 7, illustrating the operational relationship of the elastic means with the piston and with the actuating means and the operational relationship of said actuating means with the shell, through the positioning means.

In the construction illustrated in FIGS. 7 and 8, the positioning means 80 comprises a drive rod 83 affixed, by an end 83*a*, to a base portion 61 of the actuating means 60, and projecting from said base portion 61, to have an opposite end 83*b* affixed, through a spring element 84 in the form of a flat spring, to the shell 20. In this construction, the base portion 61 of the actuating means is massive, receiving and securing, in a face turned to the elastic means 70, an adjacent end thereof and securing, from an opposite face, the adjacent end 83*a* of the positioning rod 83.

In this construction, the elastic means 70 has an end affixed to the piston 40 through a drive rod portion 90, appropriately configured to retain an adjacent end of the elastic means 70. Further in this construction, the drive rod portion 90 is defined in a single piece with the piston 40, and in the form of an enlarged portion thereof opposed to a compression portion disposed in the interior of the compression chamber C.

The positioning means 80, in any of the constructions presented herein, forces the maintenance of the condition of the phase opposition displacements between the piston 40 and the actuating means 60 and of the nominal value of the displacement amplitudes thereof. This positioning means 80 is applied in the constructions in which the elastic means 70 does not guarantee, by itself, the correct value of the amplitudes of the reciprocating displacements of both the piston 40 and the actuating means 60, such as, for example, in situations of motor overload.

In any of the constructive options discussed above, the positioning means 80 is dimensioned to remain in a rest condition, which represents a balance condition of phase opposition displacements of both the piston 40 and the actuating means 60, said positioning means 80 continuously forcing the part to which it is connected to this balance condition, as a function of its previous dimensioning and constructive characteristics. The positioning means 80 continuously forces the part to which it is connected to a position corresponding to a non-deformed rest position of the elastic means 70.

In one of the different embodiments of the present invention, the shell 20 comprises an elongated tubular body generally in metallic alloy and internally defining a hermetic chamber HC between the linear electric motor 50 and the cylinder 30, said hermetic chamber HC being open to a first end of the compression chamber C and lodging the actuating means 60 and the elastic means 70.

A valve plate 110 of any known prior art construction is seated and secured against a second end of the compression chamber C, closing it. An end cover 120 is externally seated and retained against the valve plate, said end cover 120 and said valve plate 110 internally providing selective fluid communications between the compression chamber C and the suction and discharge lines, not illustrated, of a refrigeration circuit to which the compressor is coupled.

According to the present invention, an end cover 120 is secured around at least part of the longitudinal extension of the adjacent shell portion surrounding the valve plate 110, said fixation being made, for example, through adhesives or mechanical interference, such as by the actuation of an inner thread 123 provided in the end cover 120 and to be engaged to an outer thread 22 provided in the adjacent portion of the shell 20.

The valve plate 110, in which are defined a suction orifice 111 and a discharge orifice 112 selectively closed by a respective suction valve 113 and a respective discharge valve 114 (see FIG. 15), is seated against the second end of the compression chamber C, closing said compression chamber 31, said second end of the compression chamber C being opposed to the one to which is mounted the piston 40.

In the compressor construction presenting a shell 20, as illustrated in the enclosed drawings, said compressor presents the relatively moving parts thereof constructed to dispense the provision of a lubricant oil for the compressor, as well as a reservoir for said oil and means for pumping it to the parts with relative movement.

In a constructive option of the present invention, the relatively moving parts of the compressor are made of a self-lubricant material, such as, for example, some plastics. In another constructive option of the present invention, said relatively moving parts are made of an antifriction material, or provided with a low friction wear-resistant coating.

In a way of carrying out of the present invention, the piston 40 is produced in a self-lubricant material, such as, for example, some engineering plastics, or in conventional materials coated with low friction wear-resistant surface coating. The compression chamber C, inside which occurs the displacement of the piston 40, may also receive, circumferentially and laterally, a tubular jacket made of an antifriction material and secured in the interior of the shell 20, as cited above.

Besides reducing the friction between the relatively moving parts, the determination of the material that forms the components of the compressor of the present invention considers balancing issues in the compressor. Within this concept, the compressor being described preferably presents its components made of a material with low mass density, in order to reduce the unbalancing forces coming from the reciprocating movement of the piston 40. The compressor constructed according to the present invention can be utilized in a wide range of rotations, for example from 3,000 rpm to 15,000 rpm, as a function of its characteristics.

According to the present invention, the cylinder 30 is hermetically and at least partially lodged and retained in the interior of a first end portion of the shell 20, the end cover 120 being secured in one of the parts of shell 20 and cylinder 30, in order to pressurize the valve plate 110 against the cylinder 30.

In the illustrated construction of tubular shell 20, the fluid communication between the compression chamber C and the discharge line is defined by a discharge chamber 122 defined in the interior of the end cover 120 and the fluid communication between the compression chamber C and the suction line is defined by a connecting means 121 formed in the interior of the end cover 120 and lodging an adjacent end of the suction line.

In a constructive variant of the present invention, illustrated in the enclosed drawings, the end cover 120 further comprises a cylinder cover 125 disposed between the valve plate 110 and the end cover 120, the latter exerting pressure against the valve plate 110 by means of the cylinder cover 125, said cylinder cover 125 being, for example, surrounded by the end cover 120.

In this constructive variant, the fluid communication between the compression chamber C and the discharge line is defined by a discharge chamber 122 formed in the interior of the cylinder cover 125 and the fluid communication between the compression chamber C and the suction line is defined by a connecting means 121 for an adjacent end of the suction line, formed in the interior of the cylinder cover 125.

Although the constructions illustrated herein present a fluid communication between the compression chamber C and the suction line through a connecting means 121, it should be understood that the present invention is also applied to constructions in which the fluid communication between the suction line and the compression chamber C is accomplished through a suction chamber provided in the end cover 120 or in a cover internal to the latter, as described ahead.

The supply of refrigerant gas through the connecting means 121 is carried out directly and hermetically to the interior of the compression chamber C of the cylinder 30, through the suction valve 113.

The discharge chamber 122 is defined so that to maximize the use of its inner volume for attenuating the refrigerant gas pulses generated by the compressor operation, and to provide insulation between the existing discharge volume and the suction line. In a constructive option, this construction further provides the fixation of the discharge valve system.

According to a way of carrying out of the present invention, the end cover 120 is constructed in a single piece, being internally provided with the connecting means 121 and the discharge chamber 122. However, other constructions are possible within the concept presented herein, in which, for example, a cylinder cover 125 internal to the end cover 120 is seated against the valve plate 110, as described ahead, said cylinder cover 125 being, for example, partially or totally surrounded by the end cover 120. In this construction, the cylinder cover 125 internally defines the connecting means 121, which provides fluid communication between the compression chamber C and the suction line, and a discharge chamber 122 which receives the gas compressed in the compression chamber C and to be directed to the discharge line.

In this construction, to maintain the seating condition of the parts of cylinder cover 125 and valve plate 110 against the adjacent portion of the shell 20, the end cover 120 is pressed and welded to said shell 20.

The fixation of the end cover 120 to the shell 20 results in greater hermeticity for the compressor, also permitting to reduce the dimensions thereof, by eliminating the provision of flange portions for the mutual seating of parts secured to each other by means of screws, rivets, etc.

According to the present invention, the maintenance of the sealing between the suction and discharge sides defined in the end cover 120 or in the cylinder cover 125, during operation, is guaranteed by the provision of sealing gaskets 140. Alignment pins (not illustrated) may be utilized to guarantee the positioning of the components which define the closing of the end of the shell 20 where the valve plate 110 is seated and which define the compressor head. A sealing gasket 140 is applied between said end of the shell 20 and the valve plate 110 to adjust the compression chamber C and limit the harmful (dead) volume existing in the latter.

As illustrated, the second end portion of the shell 20 extends beyond the linear electric motor 50, to be closed by a motor cover 150 defining, between the latter and the linear electric motor 50, a hermetic plenum 151 maintained in fluid communication with the hermetic chamber HC through the linear electric motor 50.

According to the present invention, at least one of the parts of shell 20 and end cover 120 (or cylinder cover 125) may also be externally provided with heat exchange fins, for refrigerating the compressor during its operation and for releasing, to the outside of the compressor, the heat that is generated by the motor and by the compression of the refrigerant fluid in the compression chamber C.

The invention claimed is:

1. A linear compressor comprising: a shell; a cylinder affixed to the shell and defining a compression chamber; a piston to be displaced in a reciprocating movement in an interior of the compression chamber during the operation of the compressor; a linear electric motor mounted to the shell; an actuating means operatively coupling the piston to the linear electric motor, in order to make the latter displace the piston in a reciprocating movement in the interior of the compression chamber, the actuating means being coupled to the piston by an elastic means whereby the actuating means and the piston displaced in phase opposition during the operation of the compressor.

2. The compressor, as set forth in claim 1, characterized in that the shell comprises an elongated tubular body internally defining a hermetic chamber between the linear electric motor and the cylinder, said hermetic chamber being open to a first end of the compression chamber and lodging the actuating means and the elastic means; said compressor further comprising: a valve plate seated and affixed against a second end of the compression chamber, so as to close it; an end cover affixed to one of the parts of shell and cylinder and externally seated and retained against the valve plate, pressing the latter against the cylinder, said end cover and said valve plate internally providing selective fluid communication between the compression chamber and suction and discharge lines, respectively, of a refrigeration circuit to which the compressor is coupled.

3. The compressor, as set forth in claim 2, characterized in that it comprises a cylinder cover disposed between the valve plate and the end cover, the latter pressing against the valve plate by means of the cylinder cover.

4. The compressor, as set forth in claim 3, in that the fluid communication between the compression chamber and the discharge line is defined by a discharge chamber formed in an interior of the cylinder cover.

5. The compressor, as set forth in claim 4 characterized in that the fluid communication between the compression chamber and the suction line is defined by a connecting means for an adjacent end of the suction line, formed in the interior of the cylinder cover.

6. The compressor, as set forth in claim 2 characterized in that the cylinder is hermetically and at least partially lodged and retained in an interior of a first end portion of the shell, a stator of the linear electric motor being internally affixed to a second end portion of the shell.

7. The compressor, as set forth in claim 6 characterized in that the second end portion of the shell extends beyond the linear electric motor, to be closed by a motor cover, defining, between the latter and the linear electric motor, a hermetic plenum maintained in fluid communication with the hermetic chamber, through the linear electric motor.

8. The compressor, as set forth in claim 3, characterized in that the elastic means comprises at least one resonant helical spring with an end coupled to the piston and an opposite end coupled to the actuating means.

9. The compressor, as set forth in claim 4 characterized in that the piston is coupled to the elastic means by a drive rod portion external to the cylinder and coaxial to the piston.

10. The compressor, as set forth in claim 9 characterized in that the actuating means comprises a base portion securing the elastic means and a load portion electromagnetically associated with the linear electric motor, said base portion and load portion being coaxial to each other and to the axis of the piston.

11. The compressor, as set forth in claim 10 characterized in that the elastic means has an end affixed to the drive rod portion and an opposite end affixed to the base portion of the actuating means.

12. The compressor, as set forth in claim 6, characterized in that it further comprises a positioning element mounted to one of the parts of shell and cylinder and which is elastically and operatively associated with one of the parts of piston and actuating means, in order to force the maintenance of the condition of phase opposition displacements between the piston and the actuating means, and of said displacement amplitudes thereof.

13. The compressor, as set forth in claim 12 characterized in that the positioning element comprises a spring element having an end coupled to one of the parts of cylinder (30) and shell and an opposite end affixed to one of the parts of piston and actuating means, through a positioning rod.

14. The compressor, as set forth in claim 13 characterized in that the piston is coupled to the elastic means by a drive rod portion external to the cylinder and coaxial to the piston, the positioning rod being defined by an additional extension of the drive rod portion.

15. The compressor, as set forth in claim 3 characterized in that it further comprises a positioning element coupling the region of the elastic means situated on a transversal plane to one of the parts of cylinder and shell.

16. The compressor, as set forth in claim 15 characterized in that the positioning element elastically couples said region of the elastic means situated on said transversal plane to one of the parts of cylinder and shell, said positioning element forcing the maintenance of distances between the transversal plane and a reference point contained in one of the parts of cylinder and shell.

17. The compressor, as set forth in claim 16 characterized in that the positioning element comprises a spring element.

18. The compressor, as set forth in claim 17 characterized in that the spring element has an end coupled to one of the parts of cylinder and shell and an opposite end affixed to said region of the elastic means situated on said transversal plane, through a positioning rod.

19. The compressor, as set forth in claim 13 characterized in that the positioning element comprises a spring element (84) in the form of a flat spring that is peripherally affixed to the shell and medianly affixed to the positioning rod (83).

20. The compressor, as set forth in claim 13, characterized in that the elastic means comprises at least one resonant helical spring with an end coupled to the piston and an opposite end coupled to the actuating means, said positioning rod being disposed axially and internally in relation to the resonant helical spring.

21. The compressor, as set forth in claim 15 characterized in that the positioning element rigidly couples said region of the elastic means situated on said transversal plane to one of the parts of cylinder and shell, maintaining said positioning element affixed in relation to the respective part.

22. The compressor, as set forth in claim 20, characterized in that the positioning element comprises the positioning rod having an end coupled to said region of the elastic means and an opposite end affixed to one of the parts of cylinder and shell.

23. The compressor, as set forth in claim 13 characterized in that the actuating means comprises a base portion securing the elastic means and a load portion electromagnetically associated with the linear electric motor, said positioning rod being disposed through the base portion of the actuating means, coaxial to the axis of the piston.

* * * * *